United States Patent [19]

Chiou

[11] Patent Number: 4,825,485

[45] Date of Patent: May 2, 1989

[54] STABLE WATER BED

[76] Inventor: Golong Chiou, 2-3, Kin Chern Rd.,, Sheau Gang Dist. Kaohsiung,, Taiwan

[21] Appl. No.: 172,232

[22] Filed: Mar. 23, 1988

[51] Int. Cl.[4] ..... A47C 27/08

[52] U.S. Cl. ..... 5/451; 5/457

[58] Field of Search ..... 5/457, 451, 450, 449, 5/458, 441, 452

[56] References Cited

U.S. PATENT DOCUMENTS

| | | | |
|---|---|---|---|
| 3,286,285 | 11/1966 | Harvey | 5/457 |
| 3,456,270 | 7/1969 | Weinstein et al. | 5/451 |
| 4,241,465 | 12/1980 | Yarimie et al. | 5/457 |
| 4,292,702 | 10/1981 | Phillips | 5/457 |
| 4,348,282 | 11/1982 | Viesturs | 5/457 |
| 4,371,999 | 2/1983 | Reid | 5/457 |
| 4,611,357 | 9/1986 | Chelin | 5/457 |

FOREIGN PATENT DOCUMENTS

| | | | |
|---|---|---|---|
| 1274076 | 9/1961 | France | 5/457 |

*Primary Examiner*—Alexander Grosz

*Attorney, Agent, or Firm*—Larson and Taylor

[57] ABSTRACT

A stable water bed is made up of upper and lower layers adhered together around their edges to form sides which have an oval shape. A plurality of separating walls are adhered inside both layers by means of high frequency bonding. These walls are provided with small oval-shaped holes for slow and even flowing of the water in this bed. The ends of the separating walls terminate in the oval-shaped portions of the sides.

3 Claims, 3 Drawing Sheets

STABLE WATER BED

BACKGROUND OF THE INVENTION

Traditional water beds generally lack stability when a person lies on it, as the water is liable to move around inside the plastic bag as he/she moves his/her body. However, this water movement does provide a cooling action to the user in hot weather. To decrease the swaying movement of water beds, there has been disclosed the using of a layer of foam rubber or floating balls inside the plastic bag. However, the improvement is only marginal. In fact, such water beds may have more movement in other directions.

SUMMARY OF THE INVENTION

This invention concerns a stable water bed made up of upper and lower layers of a leather-like plastic adhered together around their edges by means of high frequency bonding. Provided inside these layers are a plurality of separating walls adhered to the upper and lower layers at 10 to 15 centimeter intervals. Each of these walls is provided with a plurality of small holes, and both ends of each wall adhere to curved surfaces of the upper and lower layers.

DETAILED DESCRIPTION OF THE PREFERRED EMBODIMENT

Figure 1:
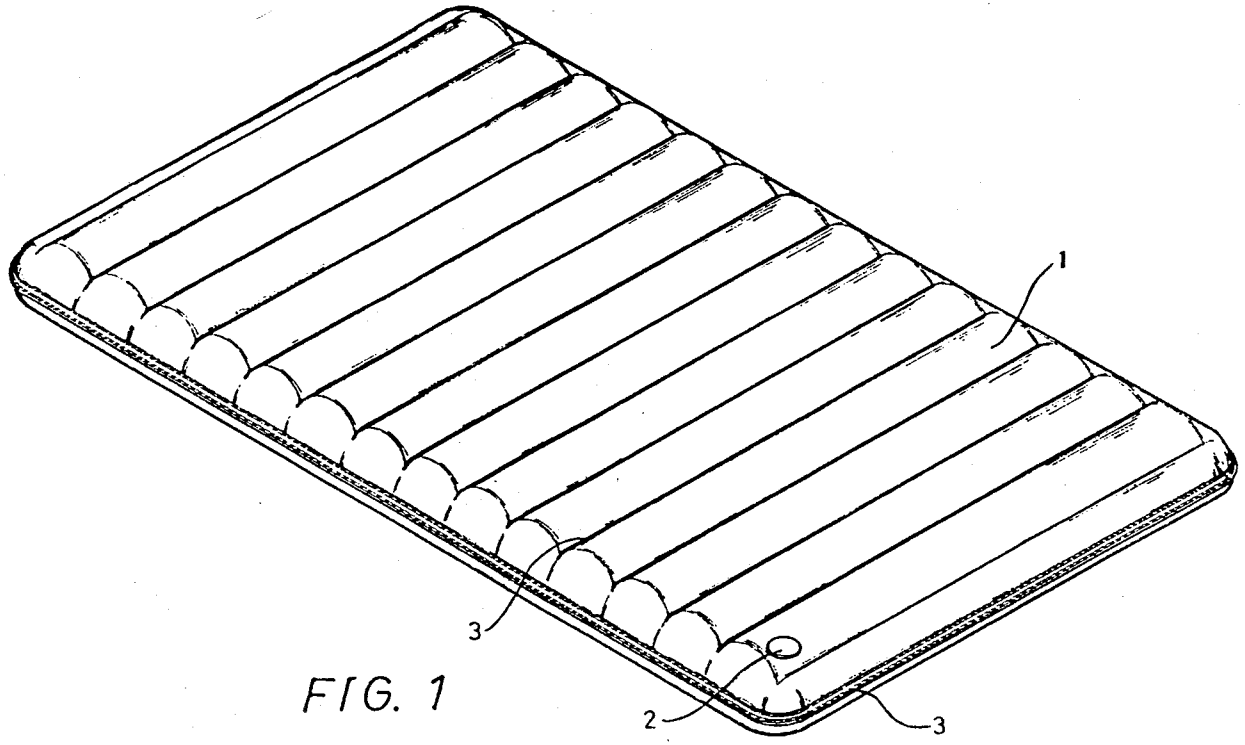
FIG. 1 is a perspective view of a stable water bed in accordance with the present invention.

This stable water bed as shown in FIG. 1 comprises a bed 1 made up of upper and lower layers of plastic leather stuck together around their edges by means of high frequency bonding. A filling hole 2 is provided at a corner on the upper layer which is used for filling the inside of bed 1 with water.

Figure 2:
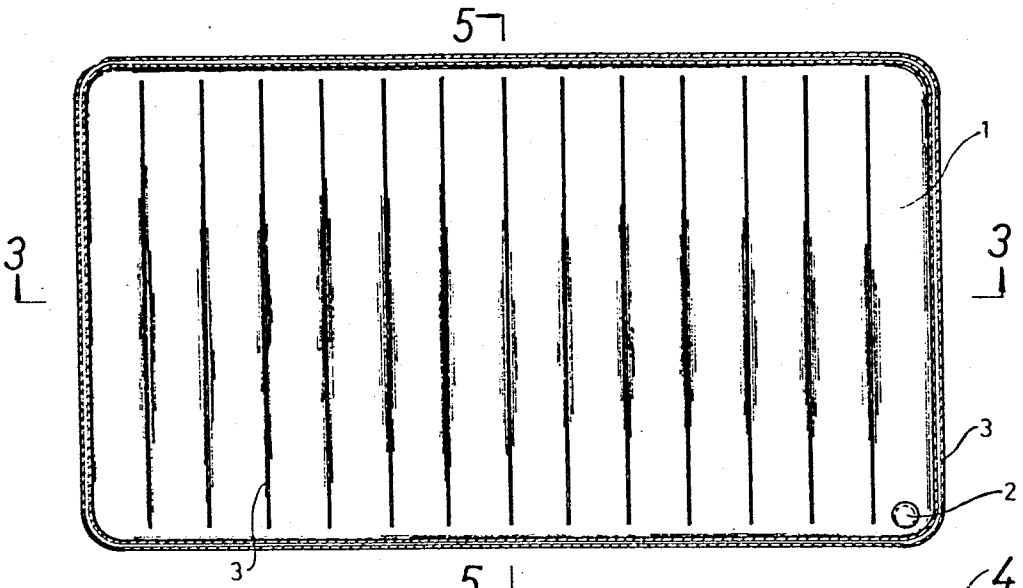
FIG. 2 is a top plan view of the stable water bed depicted in FIG. 1.
Figure 3:
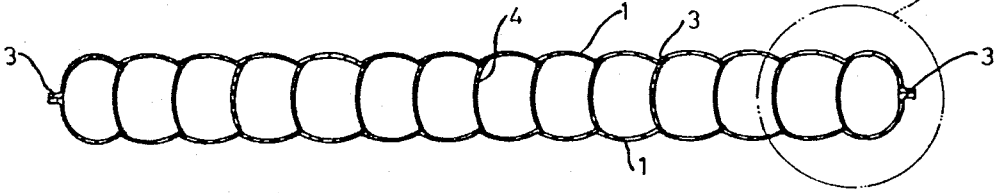
FIG. 3 is a cross-sectional view taken along line 3—3 of FIG. 2.

As shown in FIGS. 2 and 3, in addition to adhering lines 3 formed around bed 1 by means of the high frequency bonding, a plurality of separating walls 4 are adhered with the upper and lower layers by means of high frequency bonding so that adhering lines 3 are also provided laterally across bed 1. Separating walls 4 are provided at intervals of 10 to 15 centimeters, so that bed 1 is divided into a plurality of long narrow sections.

Figure 4:
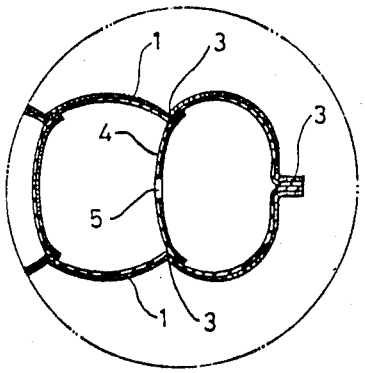
FIG. 4 is an enlarged view of the portion marked 4 on FIG. 3.

FIG. 4 shows that the upper and lower layers of bed 1 and separating walls 4 are made of double sheets of plastic leather so as to strengthen the resistive force thereof against the water pressure caused by a person lying on bed 1. Walls 4 are provided with a plurality of small holes 5 which are staggered from one wall 4 to the adjacent wall 4. Thus, holes 5 of one wall 4 do not face straight ahead to holes 5 of an adjoining wall 4.

Figure 5:
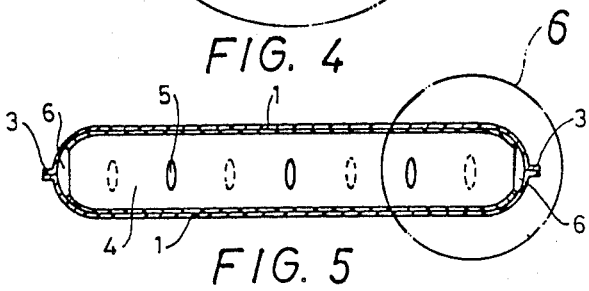
FIG. 5 is a cross-sectional view taken along line 5—5 of FIG. 2.
Figure 6:
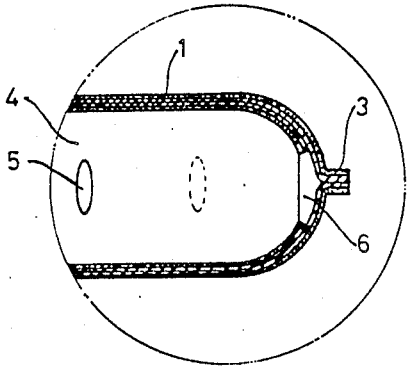
FIG. 6 is an enlarged view of the portion marked 6 on FIG. 5.

Both lateral ends of each wall 4, as shown in FIGS. 5 and 6, are adhered with the upper and the lower layers near the adhering line 3 such that the height of each lateral end of each wall 4 between adhering lines 3 is approximately half of the bed height when bed 1 is filled up with water. There are water passages 6 set between the lateral ends of each wall 4 and the bed side for water to flow through. Thus, when bed 1 is filled and inflated with water, the bed sides (formed by both layers adhered with walls 4) become a series of oval-shaped sections. Consequently, the most easily breakable place, i.e., the adhering line of the ends of walls 4 to the layers, is located in a portion of the oval-shaped section. This portion of the oval-shaped section has a comparatively large enduring force against the water pressure owing to the fact that is receives the least water pressure. Water passages 6 and holes 5 in each wall only allow water to flow into the next section so that water flowing in bed 1 will not be too fast but will allow bed 1 to acquire comparative stability.

In general, the water flows slowly and evenly in bed 1, because bed 1 is divided into a plurality of long narrow sections formed by the separating walls 4. Walls 4 are provided with a plurality of small holes 5 and water passages 6 for water to flow through, so bed 1 can acquire better stability without swaying too much even if a person lying on it moves his body. Therefore, the user can sleep on it comfortably. In addition, there is a reduced chance that the water pressure can break any adhering line 3 because of the oval side faces where adhering takes place and thus bed 1 can last a long time.

What is claimed is:

1. A stable water bed comprising:

an upper layer and a lower layer adhered together by high frequency bonding around respective edges thereof such that sides having an oval-shaped cross section are provided;

a plurality of separating walls, each said separating wall being adhered to said upper layer and said lower layer such that said separating walls divide the bed into a series of parallel long narrow sections, each said separating wall having opposite, substantially straight, vertical ends which extend to said oval-shaped sides and which terminate in the associated said oval-shaped side at a position where a height of said end extending between said upper layer and said lower layer is about one-half of a height of the bed;

water passages provided between each said end of said separating walls and an associated said side; and a plurality of oval-shaped holes provided in each said separating wall, each said holes having a vertical elongate axis.

2. The stable water bed as claimed in claim 1, wherein the interval distance among said walls is 10 to 15 centimeters.

3. The stable water bed as claimed in claim 1, wherein said holes provided in one said wall do not face straight ahead to said holes of an adjacent said wall.

* * * * *